US012150515B2

(12) United States Patent
Mariacher

(10) Patent No.: US 12,150,515 B2
(45) Date of Patent: Nov. 26, 2024

(54) CLIMBING SHOE

(71) Applicant: CALZATURIFICIO S.C.A.R.P.A. S.P.A., Asolo (IT)

(72) Inventor: Heinrich Mariacher, Asolo (IT)

(73) Assignee: CALZATURIFICIO S.C.A.R.P.A. S.P.A. (IT)

( * ) Notice: Subject to any disclaimer, the term of this patent is extended or adjusted under 35 U.S.C. 154(b) by 0 days.

(21) Appl. No.: 17/734,671

(22) Filed: May 2, 2022

(65) Prior Publication Data

US 2022/0346496 A1 Nov. 3, 2022

(30) Foreign Application Priority Data

May 3, 2021 (IT) ..... 102021000011207

(51) Int. Cl.
*A43B 13/16* (2006.01)
*A43B 5/00* (2022.01)
*A43B 13/04* (2006.01)

(52) U.S. Cl.
CPC ..... *A43B 13/16* (2013.01); *A43B 5/003* (2013.01); *A43B 13/04* (2013.01)

(58) Field of Classification Search
CPC ..... A43B 5/003; A43B 13/141; A43B 5/12; A43B 5/002; A43C 11/006; A43C 11/165
See application file for complete search history.

(56) References Cited

U.S. PATENT DOCUMENTS 2,562,514 A * 7/1951 Sibulkin ..... A43B 7/142 36/166
2008/0040950 A1* 2/2008 Mariacher ..... A43B 3/0052 36/25 R
2009/0151198 A1* 6/2009 Villegas ..... A43C 13/08 36/59 A
2016/0242498 A1* 8/2016 Sakamoto ..... A43B 13/122
2019/0373979 A1* 12/2019 Mariacher ..... A43B 13/16
2021/0085020 A1* 3/2021 Grever ..... A43B 7/144

FOREIGN PATENT DOCUMENTS

EP 933033 A2 * 8/1999 ..... A43B 5/003
EP 2274994 A1 1/2011
EP 3571948 A1 11/2019

OTHER PUBLICATIONS

Translation of EP-933033-A2 (Year: 1999).*

* cited by examiner

*Primary Examiner* — Sharon M Prange
*Assistant Examiner* — Grady Alexander Nunnery
(74) *Attorney, Agent, or Firm* — The Belles Group, P.C.

(57) ABSTRACT

Climbing shoe that comprises a shoe-upper shaped so as to accommodate and cover substantially the user's entire foot; a sole made of polymeric material, which is fixed to the bottom of the shoe-upper so as to cover at least the front part of the bottom of said shoe-upper; and at least a first tensioning band, which is made of elastomeric material and extends obliquely on the outer side and on the bottom of the shoe-upper, so as to connect the tip and the inner front side of the shoe-upper directly to the rear part of the shoe-upper, in the area above the calcaneus of the user's foot, passing over the bottom of the shoe-upper beneath said sole.

11 Claims, 4 Drawing Sheets

CLIMBING SHOE

CROSS-REFERENCE TO RELATED APPLICATIONS

This patent application claims priority from Italian patent application no. 102021000011207 filed on May 3, 2021, the entire disclosure of which is incorporated herein by reference.

TECHNICAL FIELD OF THE INVENTION

The present invention relates to a climbing shoe.

STATE OF THE ART

As is known, the currently most widespread climbing shoes comprise: a shoe-upper made of leather and/or tissue which is shaped substantially like a sock so as to accommodate and cover the user's foot, including the sole of the foot; a front tensioning band with a ribbon-like structure, which is made of a high-elasticity elastomeric material, is substantially U-bent, and is firmly fixed to the front part of the shoe-upper by gluing so as to cover the tip and the inner and outer sides of the front part of the shoe-upper; a rear tensioning band with a ribbon-like structure, which is made of a high-elasticity elastomeric material, is substantially U-bent, and is fixed by gluing astride the rear part of the shoe-upper so as to cover the area over the heel, and then extend obliquely along the two lateral sides of the shoe-upper up to reach and join the front tensioning band; and a lower sole which is made of a soft and flexible polymeric material with a high friction coefficient and substantially inextensible, and is fixed by gluing to the bottom of the shoe-upper locally overlapping the front and rear tensioning bands, so as to cover the entire sole of the user's foot.

In Patent application EP0933033 A2, on the other hand, there is disclosed a climbing shoe wherein the rear tensioning band is made in one piece with a midsole which is fixed by gluing on the phalangeal section of the bottom of the shoe-upper, underneath the sole, and is shaped so as to extend obliquely along a first lateral side of the shoe-upper up to reach the area over the calcaneus of the user's foot, and then to descend obliquely along the other lateral side of the shoe-upper up to reach and join by gluing again the midsole, substantially at the metatarsal section of the bottom of the shoe-upper.

The front tensioning band, on the other hand, is replaced by an oblong-shaped patch, which is made of elastomeric material and is fixed on the shoe-upper so as to cover and protect only the tip of the shoe-upper and then rise along the upper part of the shoe-upper in a nearly sagittal direction, while leaving the inner and outer sides of the front part of the shoe-upper uncovered.

In other words, the patch only covers and protects the central area/section of the upper-front part of the shoe-upper. In some points of the climbing shoe, the user's toes are therefore covered only by the sock-like shoe-upper.

Unfortunately, despite offering a good adapting capability to the morphology of the tip of the user's foot, for many users the climbing shoe described in Patent application EP0933033 A2 does not adequately protect the user's toes from impacts, and furthermore it does not offer adequate forefoot restraining capacity during climbing, with the operating limits that this entails.

SUBJECT AND SUMMARY OF THE INVENTION

Aim of the present invention is to realize a climbing shoe which is able to overcome the drawbacks of the climbing shoe described in Patent application EP0933033 A2, while still ensuring a high adaptability to the morphology of the user's foot.

In accordance with these aims, according to the present invention there is provided a climbing shoe as defined in claim 1 and preferably, though not necessarily, in any one of the Claims depending on it.

BRIEF DESCRIPTION OF THE DRAWINGS

The present invention will now be described with reference to the attached drawings, which illustrate a non-limiting embodiment thereof, wherein:

FIG. 6 is a view of the upper-front part of the climbing shoe shown in FIG. 1, with parts removed for clarity's sake; whereas

DETAILED DESCRIPTION OF PREFERRED EMBODIMENTS OF THE INVENTION

Figure 1:
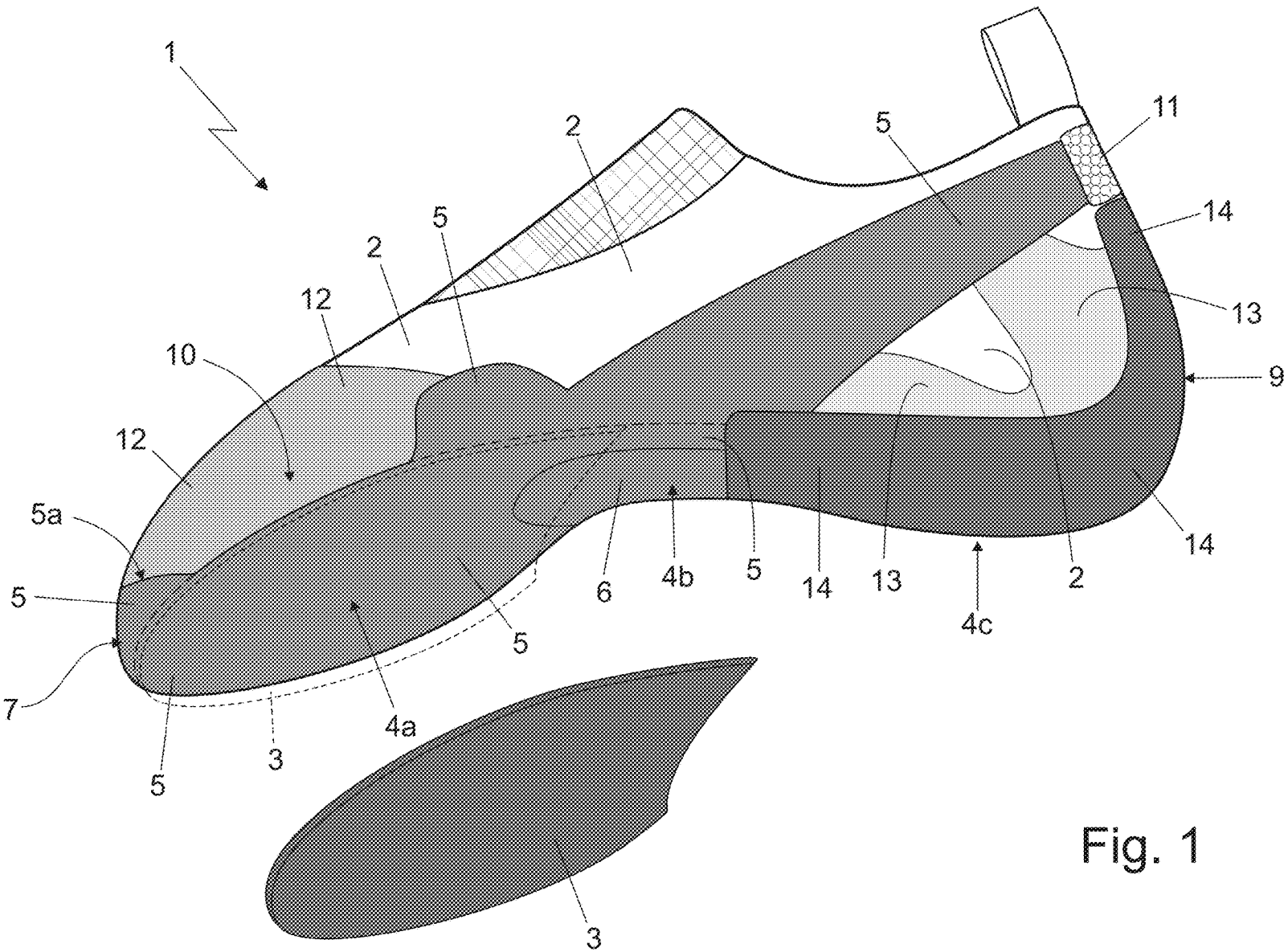
FIG. 1 is a perspective and schematic view of a climbing shoe realized according to the teachings of the present invention.
Figure 2:
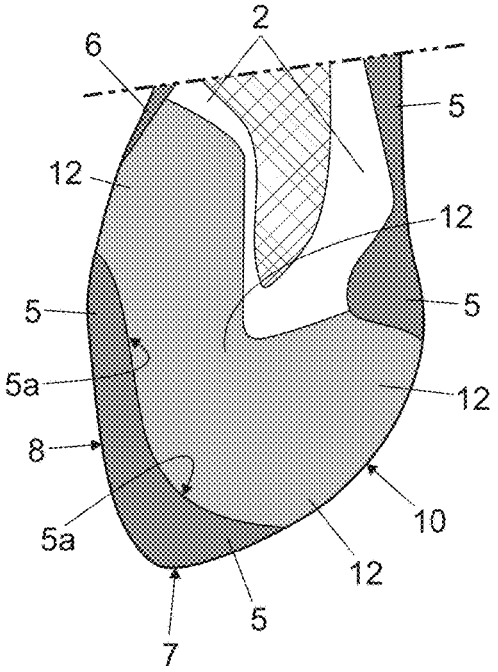
FIG. 2 is a view of the upper-front part of the climbing shoe shown in FIG. 1.
Figure 6:
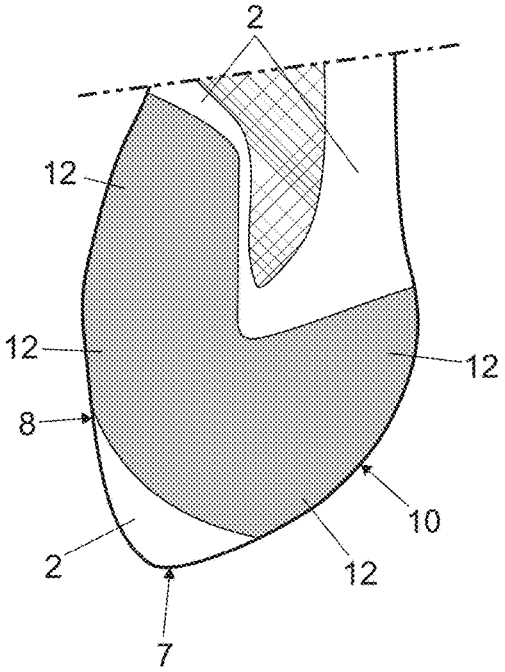

With reference to FIGS. 1 to 6, reference number 1 denote as a whole a climbing shoe that may be particularly advantageously used for climbing rock walls classified as grade IV or higher.

The climbing shoe 1 firstly comprises: a shoe-upper 2 preferably made of leather and/or tissue, which is shaped substantially like a sock so as to completely accommodate and cover the user's foot, including the sole of the foot; and a sole 3 made of a soft and flexible polymeric material with a high friction coefficient and preferably also inextensible, which is firmly fixed to the bottom 4 of the shoe-upper 2 preferably by gluing, so as to cover at least the front part of the bottom 4 of the shoe-upper 2.

More in detail, the front part of shoe-upper 2 is intended to accommodate the user's forefoot. The rear part of the shoe-upper 2, in turn, is shaped so as to cover and protect the calcaneus of the user's foot.

The bottom 4 of the shoe-upper 2, i.e. the piece of the shoe-upper 2 covering the sole of the user's foot, on the other hand is longitudinally divided into a front or tarsus-phalangeal section 4*a* located immediately underneath the phalangeal region of the sole of the user's foot; a central or metatarsal section 4*b* located immediately underneath the metatarsal region of the sole of the user's foot, i.e. underneath the plantar arch; and a rear or talus-calcaneal section 4*c* located immediately underneath the talus-calcaneal region of the sole of the user's foot.

The sole 3 is preferably shaped/dimensioned so as to substantially cover the entire front or phalangeal section 4*a* of the bottom 4 of the shoe-upper 2, and optionally also a part of the adjacent central or metatarsal section 4*b*.

In other words, the sole 3 is preferably shaped/sized so to leave the rear or talus-calcaneal section 4*c* of the bottom 4 uncovered.

Preferably the sole 3 is further made of a polymeric material having a hardness (UNI 4916) preferably lower than 80 ShoreA and optionally ranging between 50 and 75 ShoreA.

In more detail, in the example shown the front sole 3 is preferably made of a soft and flexible polymeric material, such as for example the XS Edge compound or the GRIP 2 compound manufactured by the Italian company VIBRAM S.P.A.

With reference to FIGS. 1, 2, 3 and 4, the climbing shoe 1 additionally comprises a plurality of elastic tensioning, bands which are made of high-elasticity elastomeric material and are firmly fixed to the shoe-upper 2, or rather on the outer surface of the shoe-upper 2, preferably by gluing, so as to embrace and tighten the shoe-upper 2 on the user's foot. Preferably the tensioning bands are more-over pre-tensioned.

More in detail, each tensioning band has a monolithic and ribbon-like structure, and is provided with an elastic modulus (Young's modulus) significantly lower than that of the sole 3.

In other words, the tensioning bands are preferably provided with an elastic modulus 2-10 times lower than that of the sole 3.

In addition, the elastomeric material forming at least one and more conveniently each tensioning band preferably has a hardness (UNI 4916) higher than that of the polymeric material forming the sole 3.

With reference to FIGS. 1 to 4, in particular, the front part of shoe-upper 2 is substantially ogival in shape and is provided with a tip and, respectively, with an outer front side and with an inner front side that are arranged on opposite sides of the tip so as to flank the user's forefoot on both sides.

The climbing shoe 1 is provided with an outer tensioning band 5 and an inner tensioning band 6, both with a monolithic structure.

The outer tensioning band 5 extends obliquely on the outer side and on the bottom 4 of shoe-upper 2, and is adapted to connect the tip 7 and only the inner front side 8 of the shoe-upper 2 directly with the rear part 9 of the shoe-upper 2, i.e. with the part of shoe-upper 2 that covers and protects the calcaneus of the user's foot, passing over the bottom 4 of shoe-upper 2, under the sole 3.

More in detail, the outer tensioning band 5 is adapted to connect the area of the rear part 9 of shoe-upper 2 that is located immediately over the calcaneus of the user's foot, directly to the tip 7 and to the only inner front side 8 of shoe-upper 2, passing under the sole 3.

In addition, the outer tensioning band 5 is preferably firmly fixed to the outer surface of shoe-upper 2 substantially without interruptions, preferably by gluing, and is preferably also pre-tensioned.

The inner tensioning band 6, on the other hand, extends obliquely on the inner lateral side of the shoe-upper 2, and is adapted to connect the rear part 9 of shoe-upper 2 directly to the outer tensioning band 5 roughly at the central or metatarsal section 4*b* of the bottom 4 of shoe-upper 2.

More in detail, the inner tensioning band 6 is adapted to connect the area of the rear part 9 of shoe-upper 2 which is immediately above the calcaneus of the user's foot, directly with the section of outer tensioning band 5 that substantially covers the central or metatarsal section 4*b* of the bottom 4.

In addition, the inner tensioning band 6 is preferably firmly fixed to the outer surface of shoe-upper 2 substantially without interruptions, preferably by gluing, and is preferably also pre-tensioned.

With reference to FIGS. 1, 2, 3 and 4, moreover, the outer tensioning band 5 preferably has the front portion shaped/dimensioned so as to substantially entirely cover the front or phalangeal section 4*a* of the bottom 4 of shoe-upper 2, and optionally also at least a part of the adjacent central or metatarsal section 4*b* of the bottom 4.

Moreover, the front part of the outer tensioning band 5 is shaped/dimensioned so as to extend on the upper part of the shoe-upper 2 to cover, preferably without interruptions, also the tip 7 and the inner front side 8 of the shoe-upper 2, while instead leaving the outer front side 10 of the shoe-upper 2 uncovered.

More in detail, the front part of tensioning band 5 is preferably provided with a curved appendage or end flap 5*a*, which is bent upwards so as to cover the ogival tip 7 and the inner front side 8 of shoe-upper 2, preferably roughly up to the height of the plantar arch, while instead leaving the outer front side 10 of shoe-upper 2 uncovered.

In other words, the front end of the outer tensioning band 5 is shaped so as to form an oblong pocket that contains and covers the ogival tip 7 and the inner front side 8 of shoe-upper 2, while instead leaving the outer front side of the shoe-upper 2 uncovered.

Preferably, at least at the tip 7, the curved appendage or end flap 5*a* of tensioning band 5 is furthermore fixed directly to the outer surface of shoe-upper 2 preferably by gluing.

Figure 3:
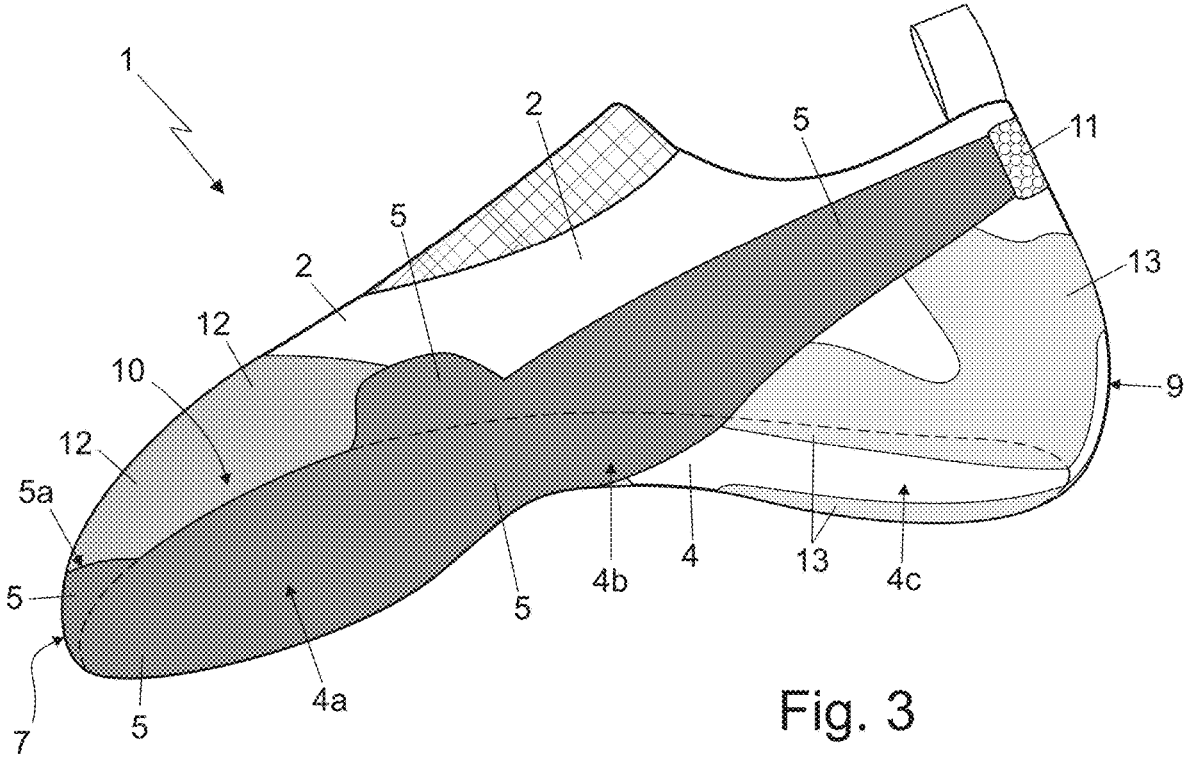
FIGS. 3, 4 and 5 are perspective views of the climbing shoe shown in FIG. 1, with parts removed for clarity's sake.
Figure 4:
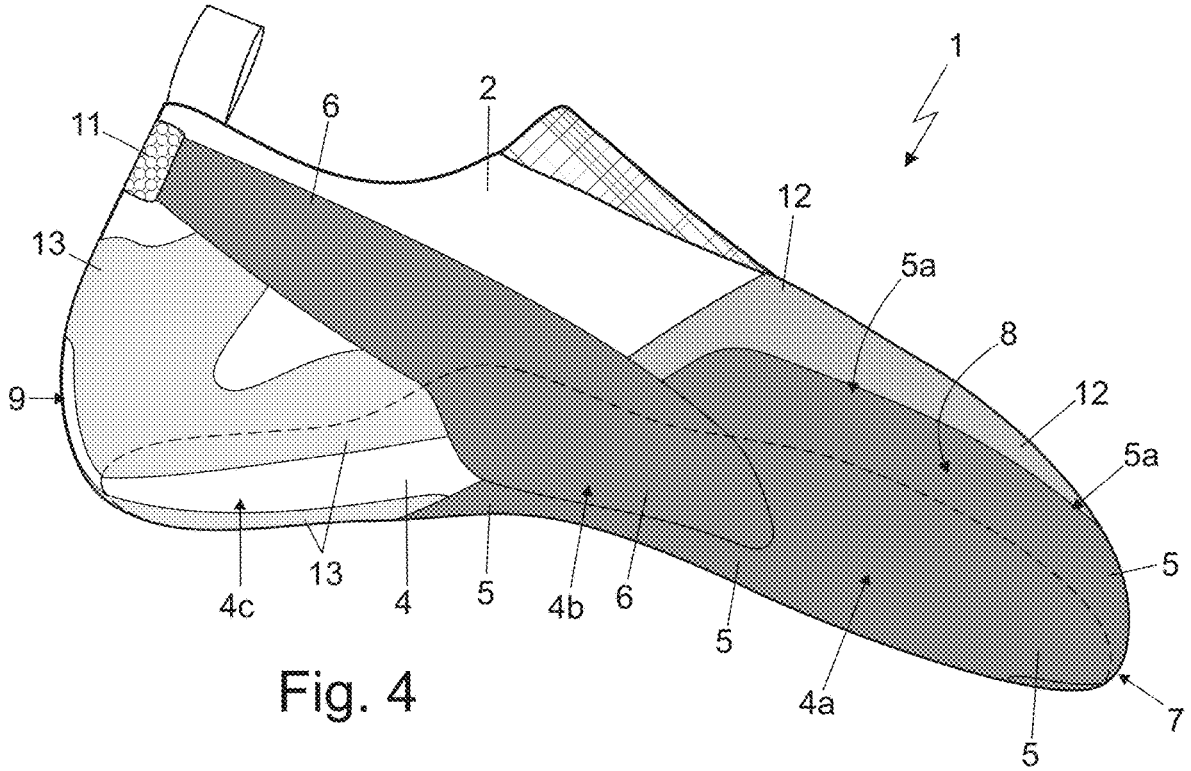
Figure 5:
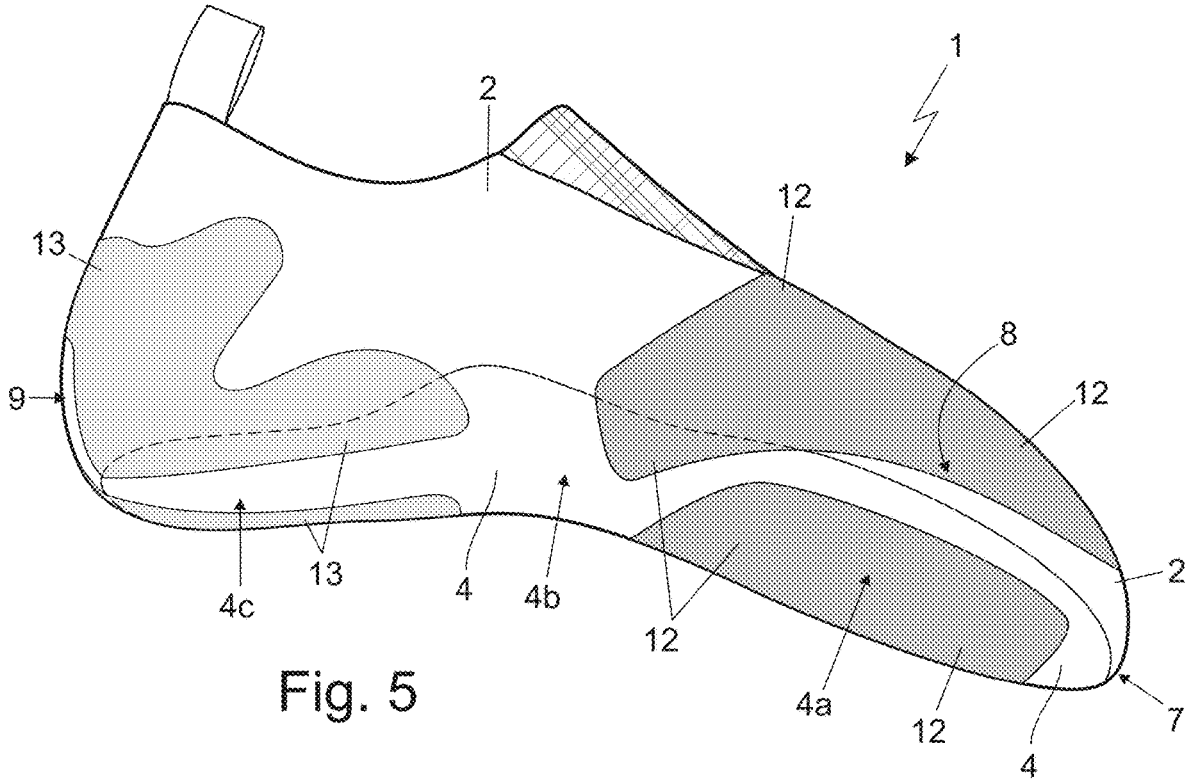

With reference to FIGS. 1, 3 and 4, on the other hand, the rear end of outer tensioning band 5 is preferably firmly fixed to a small pressure-relieving saddle-shaped patch 11, separate and distinct from tensioning bands 5 and 6, which is made of a soft and flexible material and is firmly fixed/located on the rear part 9 of shoe-upper 2, in the area immediately over the user's calcaneus and substantially astride the footwear midplane.

More in detail, the saddle-shaped patch 11 is preferably made of a polymeric material, and preferably has a substantially inextensible structure. In addition, the saddle-shaped patch 11 is preferably overlapped and firmly fixed to the shoe-upper 2 and/or to the rear end of outer tensioning band 5 by gluing.

Preferably the outer tightening band 5 is finally made of an elastomeric material having a hardness (UNI 4916) greater than or equal to 80 ShoreA.

The saddle-shaped patch 11, on the other hand, has a surface hardness preferably lower than that of tensioning bands 5 and 6.

With reference to FIGS. 1 and 4, the inner tensioning band 6, on the other hand, has a ribbon-like structure and is preferably adapted to connect the central part of the outer tensioning band 5 directly to the rear saddle-shaped patch 11.

More in detail, the front end of inner tensioning band 6 is preferably overlapped and/or firmly fixed to the outer tensioning band 5 preferably by gluing, roughly at the central or metatarsal section 4*b* of the bottom 4 of shoe-upper 2.

The rear end of inner tensioning band 6, on the other hand, is preferably firmly fixed to the saddle-shaped patch 11 on the opposite side with respect to the rear end of the outer tensioning band 5.

The rear ends of tensioning bands 5 and 6 are therefore arranged at opposite ends of the footwear midplane, spaced apart from each other.

Preferably, the saddle-shaped patch 11 is moreover overlapped and firmly fixed to the rear end of inner tensioning band 6 by gluing.

Preferably, the inner tensioning band 6 has a surface hardness substantially equal to that of the outer tensioning band 5.

In other words, the inner tensioning band 6 is preferably made of an elastomeric material having a hardness (UNI 4916) greater than or equal to 80 ShoreA.

With reference to FIGS. 1 to 6, preferably the climbing shoe 1 additionally comprises an oblong-shaped front protective patch 12 which is separated and distinct from the tensioning bands 5 and 6, is made of a soft and flexible elastomeric material, is arranged crosswise on the front part of shoe-upper 2 so as to cover the upper front area of shoe-upper 2 and the outer front side 10 of the shoe-upper 2, preferably while also leaving the tip 7 uncovered, and is firmly fixed to the shoe-upper 2 preferably by gluing.

In other words, the protective patch 12 is adapted to protect the part of the forefoot left uncovered by the outer tensioning band 5.

More in detail, the oblong-shaped front protective patch 12 is preferably helically wound on the front part of shoe-upper 2, so as to cover the front or phalangeal section 4*a* of the bottom 4, the outer front side 10 of shoe-upper 2, the upper front area of shoe-upper 2, and preferably also a part of the inner front side 8 of shoe-upper 2. Preferably, the protective patch 12 moreover extends on the bottom 4 of shoe-upper 2, partially covering the central or metatarsal section 4*b*.

Preferably, at the points of overlap with the front protective patch 12, the outer tensioning band 5 moreover overlaps and is firmly fixed to the protective patch 12 preferably by gluing.

In addition, the front protective patch 12 has a monolithic and ribbon-like structure, and is preferably provided with an elastic modulus (Young's modulus) lower than that of the tensioning bands 5 and 6.

Preferably, the front protective patch 12 furthermore has a surface hardness lower than that of sole 3 and/or that of tensioning bands 5 and/or 6.

More in detail, the protective patch 12 is preferably made of a polymeric material having a hardness (UNI 4916) preferably lower than 60 ShoreA and optionally ranging between 45 and 60 ShoreA.

With reference to FIGS. 1, 3 and 4, preferably the climbing shoe 1 is furthermore provided with a pair of lateral protective inserts 13 preferably made of a soft and flexible polymeric material, which are firmly fixed to the rear part 9 of shoe-upper 2 on opposite bands of the footwear midplane, preferably by gluing, and are adapted to cover the areas of the inner and outer lateral sides of shoe-upper 2 flanking the calcaneus of the user's foot.

Moreover, at overlapping points the tensioning bands 5 and 6 overlap and are firmly fixed to the protective inserts 13 preferably by gluing.

Preferably, the lateral protective inserts 13 furthermore have an elastic modulus (Young's modulus) and/or a surface hardness higher than those of the tensioning bands 5 and 6.

Preferably, the lateral protective inserts 13 are moreover shaped so as to extend onto the bottom 4 of shoe-upper 2, partially covering the rear or talus-calcaneal section 4*c* of the bottom 4.

In the example shown, in particular, the lateral protective inserts 13 are preferably made up of a single sheet of soft and flexible, elastomeric material that is substantially C-bent, and is firmly fixed to the rear part 9 of shoe-upper 2 preferably by gluing, so as to embrace the calcaneus of the user's foot.

More in detail, the sheet of elastomeric material is preferably shaped substantially in the form of a butterfly, and is arranged astride the rear part 9 of shoe-upper 2 so as to extend along the outer and inner lateral sides of shoe-upper 2, in order to embrace and protect the calcaneus of the user's foot.

In the example shown, moreover, the layer of elastomeric material has a surface hardness (UNI 4916) preferably ranging between 90 and 120 ShoreA.

With reference to FIG. 1, preferably the climbing shoe 1 is finally also provided with an oblong-shaped, rear protective patch 14, which is made of a soft and flexible polymeric material, and is firmly fixed to the rear part 9 of shoe-upper 2 preferably by gluing, so as to cover and protect the calcaneus of the user's foot.

Preferably, at the points of overlap, the protective patch 14 also overlaps the tensioning bands 5 and 6 and, possibly, the lateral protective inserts 13.

More in detail, the rear protective patch 14 has a monolithic ribbon-like structure, and is preferably substantially L-bent so as to simultaneously cover the talus-calcaneal section 4*c* of the bottom 4 and the rear part 9 of shoe-upper 2, while remaining substantially astride the footwear midplane.

In addition, the lower part of the rear protective patch 14 is preferably shaped/dimensioned so as to substantially completely cover the talus-calcaneal section 4*c* of bottom 4, and optionally also at least part of the adjacent central or metatarsal section 4*b* of bottom 4, while overlapping the tensioning bands 5 and 6 and possibly the lateral protective inserts 13.

The upper part of the rear protective patch 14, on the other hand, is preferably shaped/dimensioned so as to rise along the rear part 9 of shoe-upper 2, preferably up to arrive close to the saddle-shaped patch 11.

In addition, the rear protective patch 14 is preferably provided with an elastic modulus (Young's modulus) greater than that of tensioning bands 5 and 6, and moreover has a surface hardness preferably lower than that of tensioning bands 5 and 6 and of the lateral protective inserts 13, and optionally greater than or equal to that of the sole 3 and/or of the front protective patch 12.

In the example shown, in particular, the rear protective patch 14 is preferably made of a polymeric material having a hardness (UNI 4916) preferably lower than 70 ShoreA and optionally ranging between 45 and 60 ShoreA.

Operation of the climbing shoe 1 functioning is easily inferable from the above.

Due to its particular shape and arrangement that reaches and rises along the tip 7 and the inner front side 8 of shoe-upper 2, the outer tensioning band 5 causes a very marked curvature of the user's forefoot, accompanied by a concurrent torsion of the forefoot towards the inside of the foot.

Moreover, being disjointed from each other, the tensioning bands 5 and 6 may be fixed on the shoe-upper 2 with a different degree of pre-tensioning, thus allowing the climbing shoe 1 to bring into tension the inner and outer sides of the user's foot in a differentiated and asymmetric manner.

The advantages connected to the special shape and arrangement of the outer 5 and inner 6 tensioning bands are remarkable.

First of all, experimental tests have highlighted that the outer tensioning band 5, extending up to reach and cover the ogival tip 7 and only the inner front side 8 of shoe-upper 2, forces the user's forefoot to bend downwards in a more pronounced way and to twist inwards at the same time, thus greatly improving the restraining capacity and the footwear performance while climbing.

The outer tensioning band 5, in fact, helps the wearer's toe to support the weight of the body during the most difficult props.

In addition, the fact that the front protective patch 12 covers, without interruption, the outer front side 10 and the upper front area of shoe-upper 2, guarantees excellent protection of the user's forefoot, together with a significant adaptability to the morphology of the user's foot.

It is finally clear that modifications and variations may be made to the climbing shoe 1 without departing from the scope of the present invention.

For example, the saddle-shaped patch 11 may also be made of leather.

Figure 7:
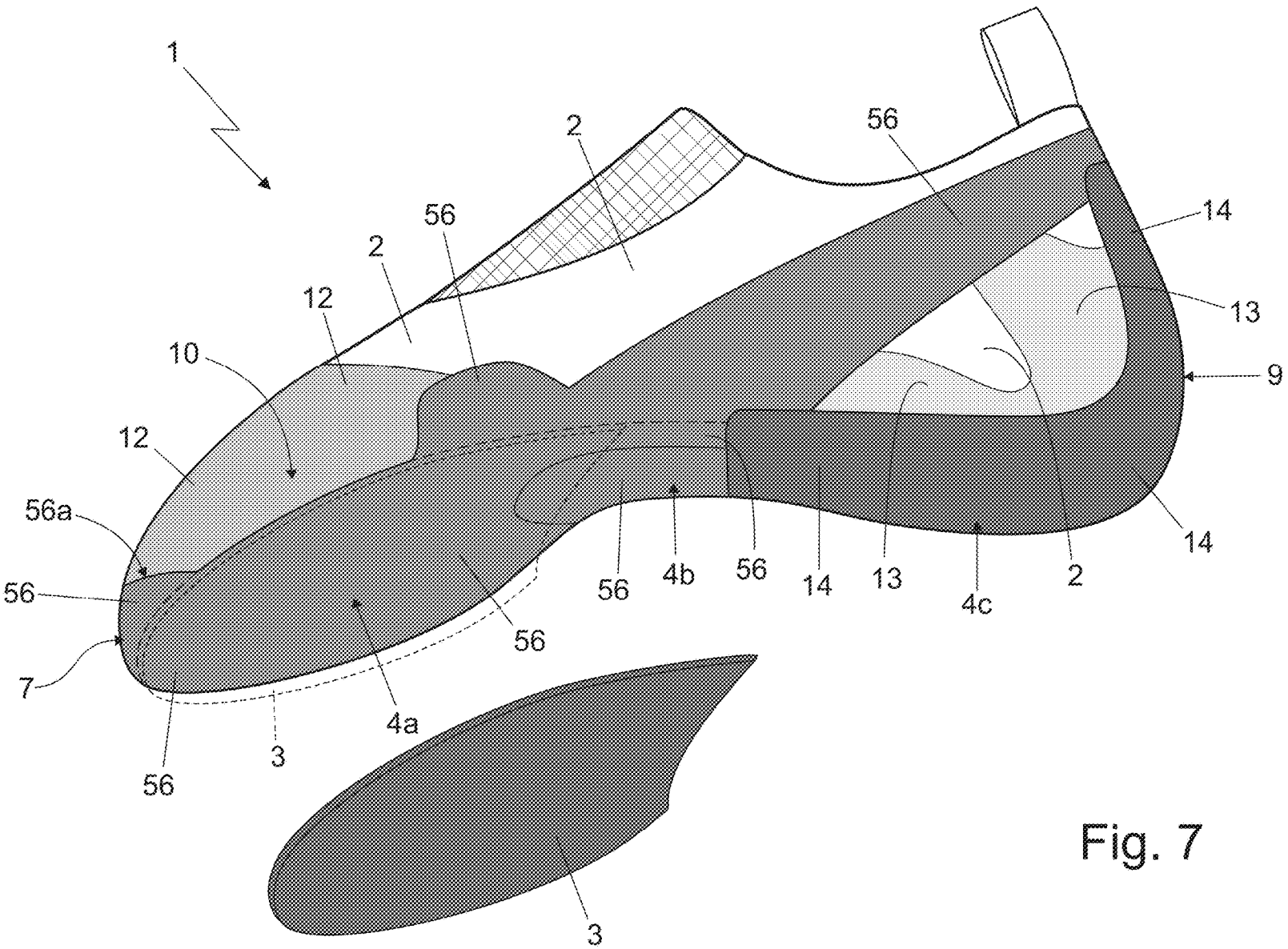
FIG. 7 is a perspective and schematic view of an alternative embodiment of the climbing shoe shown in the previous figures.

In addition, with reference to FIG. 7, in a less sophisticated embodiment, the climbing shoe 1 lacks the saddle-shaped patch 11, and the tensioning bands 5 and 6 are replaced by a single large oblong tensioning band 56, which is firmly fixed to the shoe-upper 2 so as to extend obliquely along the bottom 4 and the outer lateral side of shoe-upper 2 up to reach the area over the calcaneus of the user's foot, and then to descend obliquely along the inner lateral side of shoe-upper 2 towards the bottom 4, up to reach and stably join, preferably by gluing, an intermediate section of the same tensioning band 56, preferably more or less at the central or metatarsal section 4*b* of the bottom 4 of the shoe-upper.

Clearly, similarly to the front end of tensioning band 5, also the front end of oblong tensioning band 56 is shaped so as to extend over the upper part of shoe-upper 2, in order to cover, preferably without interruption, the tip 7 and the inner front side 8 of shoe-upper 2, while leaving uncovered the outer front side 10 of shoe-upper 2.

More in detail, similarly to the front end of tensioning band 5, the front part of the oblong tensioning band 56 is shaped so as to form an oblong pocket that contains and covers the tip 7 and the inner front side 8 of shoe-upper 2, while leaving uncovered the outer front side of the shoe-upper 2.

Even more in detail, the front part of oblong tensioning band 56 is preferably provided with a curved appendage or end flap 56*a*, which is bent upwards so as to cover the ogival tip 7 and the inner front side 8 of shoe-upper 2, preferably roughly up to the height of the plantar arch, while instead leaving the outer front side 10 of the shoe-upper uncovered.

Also in this embodiment, the protective patch 12 is arranged crosswise the front part of shoe-upper 2, so as to cover the upper front area of shoe-upper 2 and the outer front side 10 of shoe-upper 2, preferably leaving the tip 7 uncovered.

The invention claimed is:

1. A climbing shoe (1) comprising:

a shoe-upper (2) shaped so as to accommodate and cover a user's foot; a sole (3) made of polymeric material, which is fixed to a bottom (4) of the shoe-upper (2) so as to cover at least a front part of the bottom (4) of said shoe-upper (2); and at least a first tensioning band (5) that is made of elastomeric material and extends obliquely on an outer lateral side of the shoe-upper (2);

a front part of the shoe-upper (2) being provided with a tip (7) and, respectively, with an outer front side (10) and with an inner front side (8) that are arranged on opposite sides of the tip (7) so as to flank a user's forefoot on both sides;

a second tensioning band (6), which has a monolithic structure, is made of elastomeric material and extends obliquely on an inner lateral side of the shoe-upper (2) so as to connect an area of a rear part (9) of the shoe-upper (2) that is configured to be located over a calcaneus of the user's foot, directly with said first tensioning band (5) substantially at a central or metatarsal section (4*b*) of the bottom (4) of the shoe-upper (2); and a saddle-shaped patch (11) distinct and separated from said first (5) and second (6) tensioning bands, which is made of a soft and flexible material and is placed on the rear part (9) of the shoe-upper (2), configured to be in an area above the calcaneus of the user's foot; rear ends of said first (5) and second (6) tensioning bands being firmly fixed to said saddle-shaped patch (11), wherein the first tensioning band (5) has a monolithic structure and extends obliquely on the outer lateral side of the shoe upper (2) and on the bottom (4) of the shoe-upper (2), so as to connect the tip (7) and the inner front side (8) of the shoe-upper (2) directly to the rear part (9) of the shoe-upper (2), configured to be in the area above the calcaneus of the user's foot, passing on the bottom (4) of the shoe-upper (2) underneath said sole (3), and wherein a front end of said first tensioning band (5) forms an oblong pocket that covers and contains the tip (7) and the inner front side (8) of the shoe-upper (2), while leaving the outer front side (10) of the shoe-upper (2) uncovered.

2. The climbing shoe according to claim 1, wherein the front end of said first tensioning band (5) is provided with a curved appendage or end flap (5*a*) which is bent upwards so as to cover the tip (7) of the shoe-upper (2) and the inner front side (8) of the shoe-upper (2), while leaving uncovered the outer front side (10) of the shoe-upper (2).

3. The climbing shoe according to claim 1, wherein said first tensioning band (5) has the front part shaped or dimensioned so as to cover substantially an entire front or phalangeal section (4*a*) of the bottom (4) of the shoe-upper (2).

4. The climbing shoe according to claim 1, further comprising a front protective patch (12) which is separated and distinct from said first tensioning band (5), is made of a soft and flexible elastomeric material, and is firmly fixed to the shoe-upper (2) so as to cover the outer front side (10) of the shoe-upper (2) and an upper front area of the shoe-upper (2).

5. The climbing shoe according to claim 4, wherein the front protective patch (12) is oblong in shape and is arranged crosswise on the front part of the shoe-upper (2), so as to leave the tip (7) of the shoe-upper (2) uncovered by the front protective patch (12).

6. The climbing shoe according to claim 5, wherein the front protective patch (12) is helically wound on the front part of the shoe-upper (2), so as to cover a front or phalangeal section (4*a*) of the bottom (4) of the shoe-upper (2), the outer front side (10) of the shoe-upper (2) and the upper front area of the shoe-upper (2), and a part of the inner front side (8) of the shoe-upper (2).

7. The climbing shoe according to claim 6, wherein the front protective patch (12) additionally extends over the bottom (4) of the shoe-upper (2), partially covering the central or metatarsal section (4*b*) of the bottom (4) of the shoe-upper (2).

8. The climbing shoe according to claim 4, wherein the front protective patch (12) is provided with an elastic modulus lower than that of said first tensioning band (5).

9. The climbing shoe according to claim 4, wherein the front protective patch (12) has a surface hardness lower than that of said sole (3) and/or of said first tensioning band (5).

10. The climbing shoe according to claim 1, wherein said sole (3) is shaped or dimensioned so as to cover substantially an entire front or phalangeal section (4*a*) of the bottom (4) of the shoe-upper (2), and a part of the central or metatarsal section (4*b*) of the bottom (4) of the shoe upper (2).

11. The climbing shoe according to claim 1, wherein the front part of the shoe-upper (2) is ogival in shape.

* * * * *